US009254012B2

(12) United States Patent
Pham

(10) Patent No.: US 9,254,012 B2
(45) Date of Patent: Feb. 9, 2016

(54) METHOD OF BONDING FALSE EYELASHES

(71) Applicant: Trieu Dinh Pham, Rancho Cucamonga, CA (US)

(72) Inventor: Trieu Dinh Pham, Rancho Cucamonga, CA (US)

( * ) Notice: Subject to any disclaimer, the term of this patent is extended or adjusted under 35 U.S.C. 154(b) by 0 days.

(21) Appl. No.: 14/483,351

(22) Filed: Sep. 11, 2014

(65) Prior Publication Data

US 2015/0114421 A1 Apr. 30, 2015

Related U.S. Application Data

(60) Provisional application No. 61/896,841, filed on Oct. 29, 2013.

(51) Int. Cl.
*A45D 7/00* (2006.01)
*A41G 5/02* (2006.01)

(52) U.S. Cl.
CPC ..... *A41G 5/02* (2013.01)

(58) Field of Classification Search
CPC ..... A41G 5/02; A41G 5/0013; A41G 5/0053
See application file for complete search history.

(56) References Cited

U.S. PATENT DOCUMENTS

| | | | |
|---|---|---|---|
| 1,831,801 | A | 11/1931 | Birk |
| 2,079,256 | A | 5/1937 | Kaiser |
| 3,362,417 | A | 1/1968 | Glaser |
| 3,447,542 | A | 6/1969 | McCullough |
| 3,516,422 | A | 6/1970 | Bechtold et al. |
| 3,833,007 | A | 9/1974 | Jacobs |
| 3,880,175 | A | 4/1975 | Hosokawa |
| 3,900,038 | A | 8/1975 | Masters |
| 4,299,242 | A | 11/1981 | Choe |
| 6,935,348 | B2 | 8/2005 | Gold |
| D510,159 | S | 9/2005 | Song |
| 8,015,980 | B2 | 9/2011 | Rabe et al. |
| 8,061,367 | B2 | 11/2011 | Rabe et al. |
| 8,113,218 | B2 | 2/2012 | Nguyen |
| 8,127,774 | B2 | 3/2012 | Dinh |
| 8,196,591 | B2 * | 6/2012 | Lee ..... A41G 5/02 132/201 |
| 8,225,800 | B2 | 7/2012 | Byrne |
| 2003/0005941 | A1 | 1/2003 | Iosilevich |
| 2007/0023062 | A1 | 2/2007 | McKinstry et al. |
| 2007/0295353 | A1 | 12/2007 | Dinh |

* cited by examiner

*Primary Examiner* — Rachel Steitz
(74) *Attorney, Agent, or Firm* — Kirk A. Buhler; Buhler & Associates

(57) ABSTRACT

Improvements in a method to enhance eyelashes are disclosed. The method uses placement of multiple clusters along an eyelid. Because multiple flare lashes are used an installer can weave an alternating thread on opposing sides of the real lash and the false flair lashes. The thread is preferably thin and simulates the appearance of the human or false lash. The thread or hair is woven into the eyelash with a natural needle formed from horse, animal or human hair with a naturally tapering end and a slot cut or formed in the opposing end of the hair to accept thread. Glue is utilized to cement the real eyelashes to the false eyelashes and the thread or hair.

20 Claims, 4 Drawing Sheets

METHOD OF BONDING FALSE EYELASHES

CROSS REFERENCE TO RELATED APPLICATIONS

This application claims the benefit of Provisional Application Ser. No. 61/896,841 filed Oct. 29, 2013 the entire contents of which is hereby expressly incorporated by reference herein.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

1. Field of the Invention

This invention relates to improvements in application of false eyelashes. More particularly, the present invention provides a method of bonding a plurality of discreet cluster lashes to an eyelid and weaving a retaining thread(s) to the cluster lashes and eyelid.

2. Description of Related Art Including Information Disclosed Under 37 CFR 1.97 and 1.98.

False eyelashes are embellished onto the existing lashes of a person to enhance or exaggerate the appearance of natural eyelashes. The placement of false eyelashes generally consists of an elongated strip of lashes that are bonded near or on existing eyelashes of a person. In other cases a single false eyelash structure is glued above existing eyelashes, or a series of segments of false eyelash structures are interspersed among the natural eyelashes of each eye. One major problem with these methods is that the false lashes can fall off either in a collective group or as single elements.

A number of patents and or publications have been made to address these issues. Exemplary examples of patents and or publication that try to address this/these problem(s) are identified and discussed below.

U.S. Pat. No. 1,831,801 was issued on Nov. 17, 1931 to M. A. Birk and discloses a Method for the Artificial Elongation of Eyelashes. This method bonds individual lashes onto existing individual lashes. The hairs are separated and single straight or curved hairs are glued to the individual hairs at the desired angle to produce the desired visual appearance. While this method produces extenuated lashes, the lashes can fall of individually.

U.S. Pat. No. 3,833,007 issued on Sep. 3, 1974 to Peggy S. Jacobs discloses Artificial Eyelashes. The artificial lashes are individual hair clusters that are placed and above, or below, existing lashes as individual hair clusters. While this patent discloses artificial lashes the lashes can fall off of the person and they are not collectively bonded to the eyelash or together.

U.S. Pat. No. 3,900,038 issued on Aug. 19, 1975 discloses a Method of Preparing and Placing Artificial Eyelashes. The artificial lashes are individual hair clusters that are trimmed and shaped prior to being placed and above, or below, existing lashes as groups of hair clusters. While this patent discloses artificial lashes the lashes can fall off of the person and they are not collectively bonded to the eyelash or together.

U.S. Pat. No. 8,113,218 issued on Feb. 14, 2012 to Quyen T. Nguyen discloses Interlocked V-Shaped Pointed Eyelashes. A plurality of lashes is set onto the eyelid and the overlapping hair of the flared strands is bonded. While this method bonds the expanded hairs the hairs are bonded at a mid-span of the hairs and are only bonded to the eyelid with the mounting portion of the flared strands.

What is needed is a method of bonding false eyelashes that weaves the false lashes with the existing eyelashes to provide a single joined eyelash that prevents the false lashes from separating from the real lashes in pieces or clumps. The proposed method disclosed in this document provides a solution to this problem.

BRIEF SUMMARY OF THE INVENTION

It is an object of the method of bonding false eyelashes to be initially formed using clusters of flare lashes. The flare lashes allows for placement of multiple clusters along an eyelid. Because multiple flare lashes are used an installer can weave an alternating thread on opposing sides of the real lash and the false flair lashes. The use of multiple flare lashes allows the installer to adjust the density of the finished eyelash by adjusting the spacing between the multiple flare lashes.

It is an object of the method of bonding false eyelashes with thread. The thread provides a link between the false lash and the real lashes of a customer. The thread is preferably thin and simulates the appearance of the human or false lash. Weaving the thread in an alternating pattern essentially sews the real and false lashes as a single unit and prevents individual flare lashes to become dislodged and also prevents the collective unit from falling from the eye lid until the real eyelashes have sufficiently grown to no longer support the false lashes.

It is another object of the method of bonding false eyelashes to utilize a natural needle or similar instrument to weave the retaining thread that between the real lashes and the false lashes. The natural needle is preferably formed from hair, plant or other material that will not cause damage to skin or eyes. The hair needle can be a horse, animal or human hair with a naturally tapering end and a slot cut or formed in the opposing end of the hair to accept thread.

It is still another object of the method of bonding false eyelashes to utilize glue or other bonding material to cement the real eyelashes to the false eyelashes and the thread or hair. The glue essentially makes the entire structure a single joined element that prevents individual false lash components from dislodging from the collective bonded assembly and prematurely falling free from the eyelid.

Various objects, features, aspects, and advantages of the present invention will become more apparent from the following detailed description of preferred embodiments of the invention, along with the accompanying drawings in which like numerals represent like components.

BRIEF DESCRIPTION OF THE SEVERAL VIEWS OF THE DRAWING(S)

FIG. 1 shows a box of false flare lashes.
FIG. 2 shows a first step of applying flare lashes.
FIG. 3 shows all of first step complete.
FIG. 4 shows the second step of threading a binding thread.
FIG. 5 shows the third step of applying eyelash glue.

DETAILED DESCRIPTION OF THE INVENTION

Figure 1:
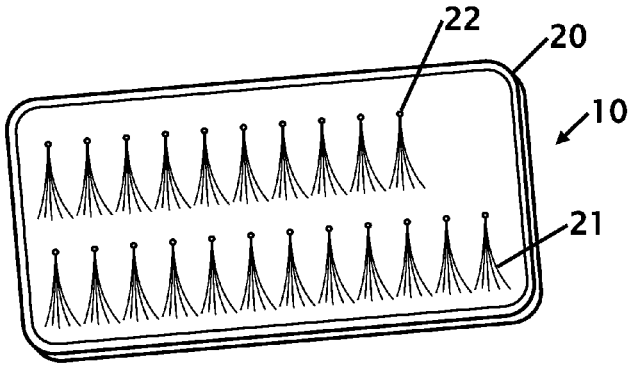

FIG. 1 shows a box 10 of false flare lashes. In the preferred embodiment the method of bonding false eyelashes starts with false eyelash segments. In this figure flare long lashes are shown. The flare lashes are available in a variety of lengths, styles and colors. The hairs are connected at on end 22 with a semi-adhesive that allows the flare lashes to both be held in the box 20 and to adhere to an eyelid. A customer and or beautician can select the style, base color. It is also contemplated that different colors and or styles can be applied at different locations along the length of an eyelid to make the eyelashes appear longer in one area as opposed to another.

Figure 2:
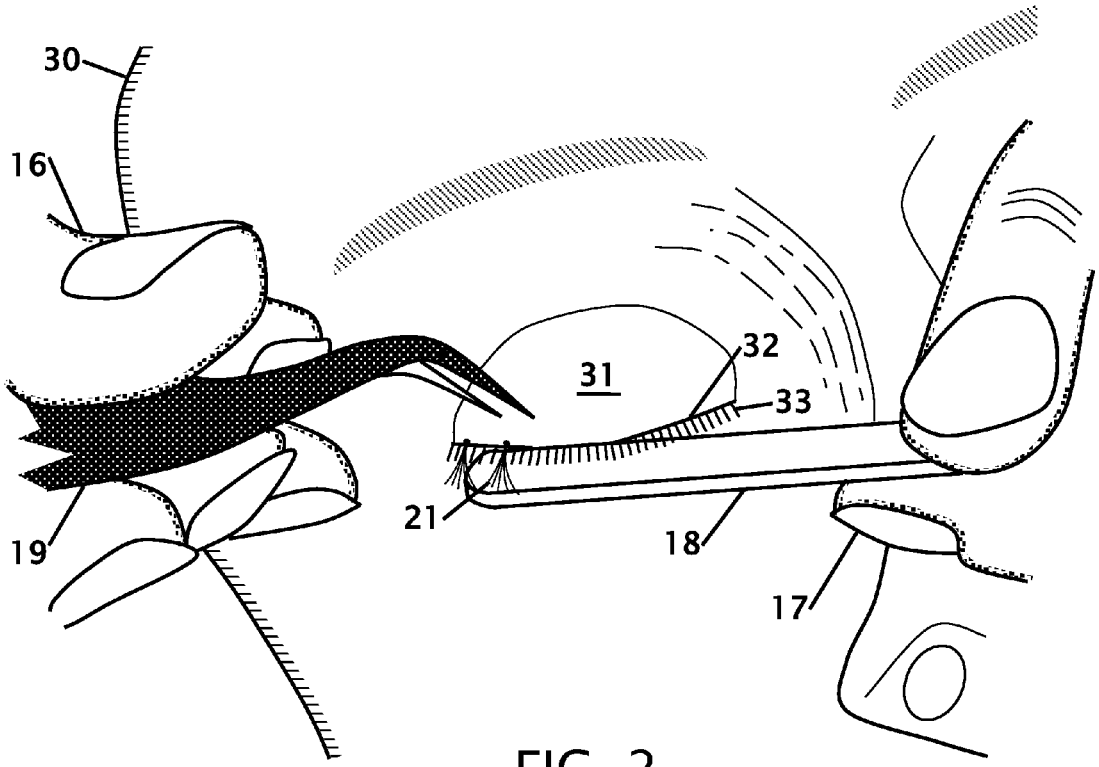

FIG. 2 shows a first step of applying flare lashes. The customer 30 closes their eyelid 31 to provide access to the entire area 32 above the eyelid 31 where the natural eyelashes 33 grow from the eyelid 32. In this figure a beautician 16 holds tweezers 19 in one hand where the beautician will select individual flare lashes 21 from the container shown in FIG. 1 and apply the flare lashes 21 along the length of the eyelid 32. In the other hand 17 of the beautician, the beautician uses a positioning tool 18, such as a flat stick or equivalent. The beautician uses the positioning tool 18 to individually and or collectively orient the flare lash(es). Because the bonding tail of the flair lashes is repositionable the beautician can remove the false lashes and reposition the flash lashes along the eyelid 32 to achieve an even spacing between the false lashes as shown in FIG. 3.

Figure 3:
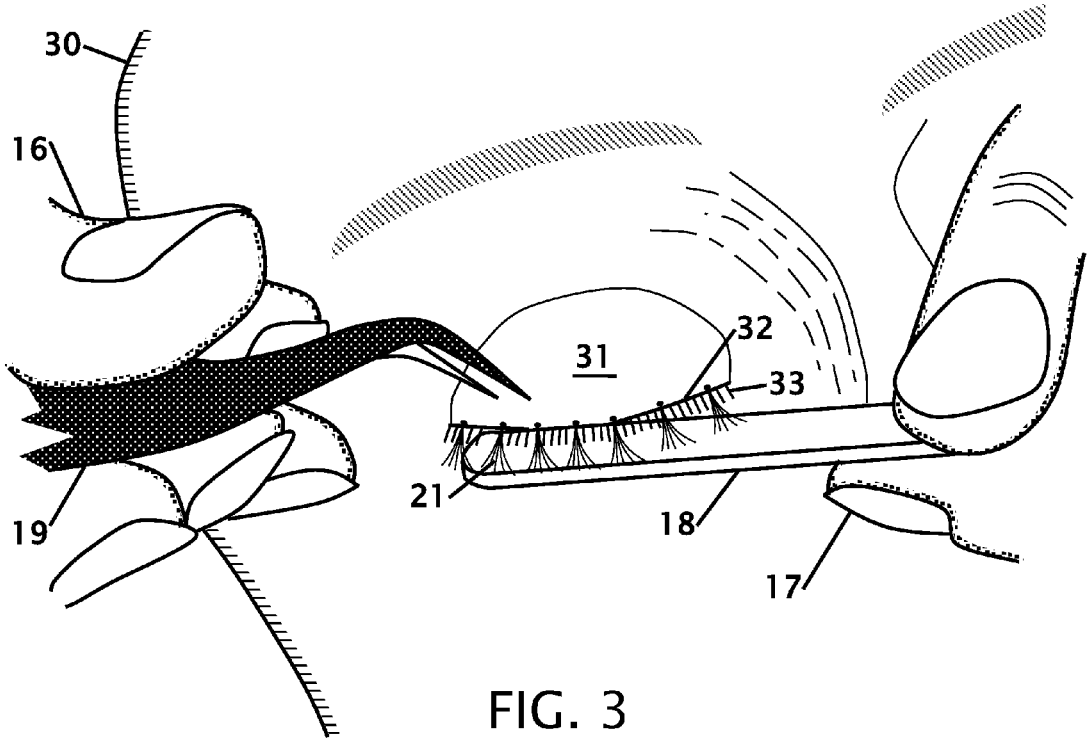

FIG. 3 shows all of first step complete. In this figure, the false lashes 21 are shown evenly distributed along the eyelid 32 with gaps between the false flair lashes 21. The bonding end of the false lash(es) is tightly oriented to be in contact with both the natural eyelashes 33 and the eyelid 32. At this stage the beautician selects and acceptable thin thread or natural hair in a color that is essentially the same as the natural eyelashes or a desirable different color.

Figure 4:
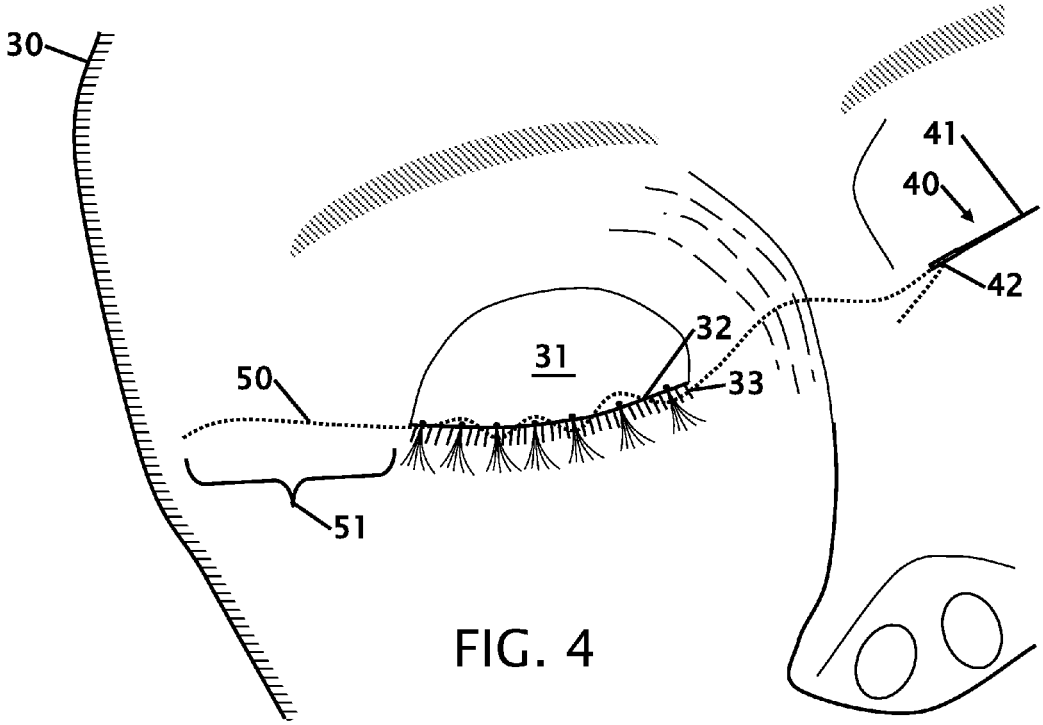

FIG. 4 shows the second step of threading a binding thread. The binding thread 50 is placed through a needle 40. While a needle is shown and described it is contemplated that the a beautician can hand weave the binding thread 50 through the natural eyelashes 33 and the flare lashes in an alternating weaving pattern as shown in this figure. The waving ensures that natural lashes are placed on both sides in the false flair lashes. Due to a fear of injury to skin or an eye, the needle 40 is preferably a natural needle or similar instrument to weave the retaining thread that between the real lashes and the false lashes. The natural needle 40 is preferably formed from hair or other material that will not cause damage to skin or eyes. The hair needle can be a horse, animal or human hair with a naturally tapering end 41 and a slot 42 cut or formed in the opposing end of the hair to accept thread 50. The thread 50 is woven leaving a tail 51 that it longer in length than the thread section woven into the eyelashes 33.

Figure 5:
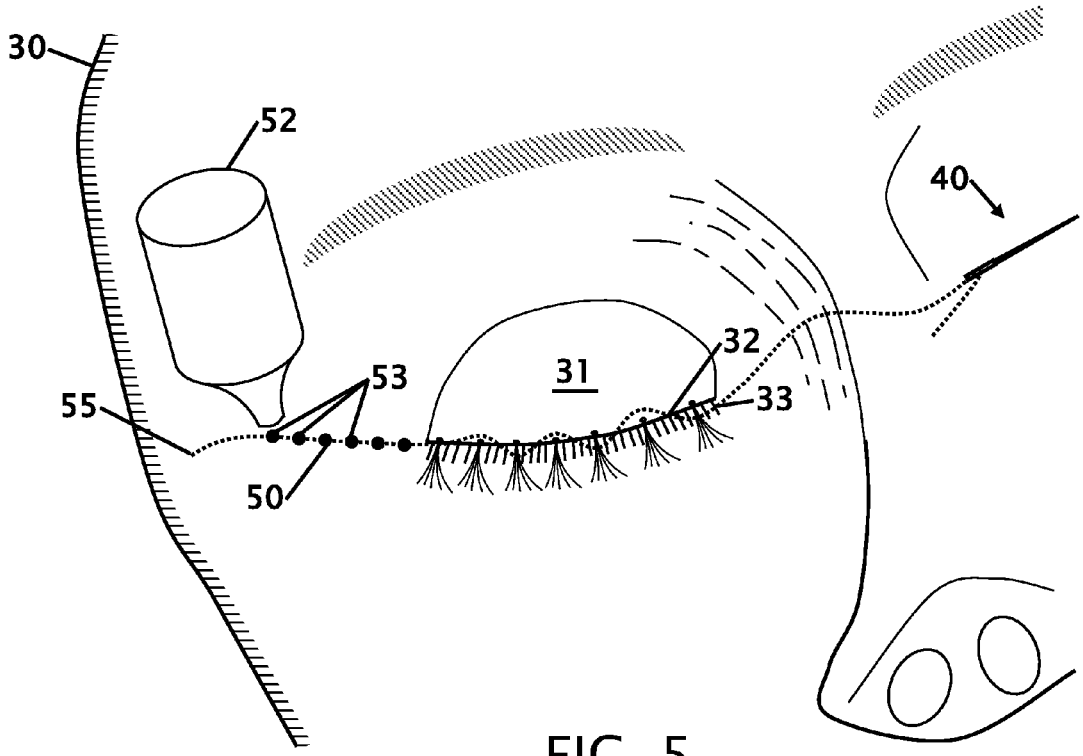

FIG. 5 shows the third step of applying eyelash glue 52. A small amount of eyelash glue 52 is applied along the free length of the thread 50 at the side opposing the needle 40. While the figure shows and described the eyelash glue 52 being applied to the free end of the thread opposing the needle it is also contemplated that the eyelash adhesive could be applied on the needle side. The amount of eyelash adhesive 53 being applied somewhat subjective based upon each application, but the amount should be sufficient to accomplish the next step without causing a pooling of the eyelash glue 53 or allowing excess eyelash glue from being squeezed out the end of the eyelashes.

Figure 6:
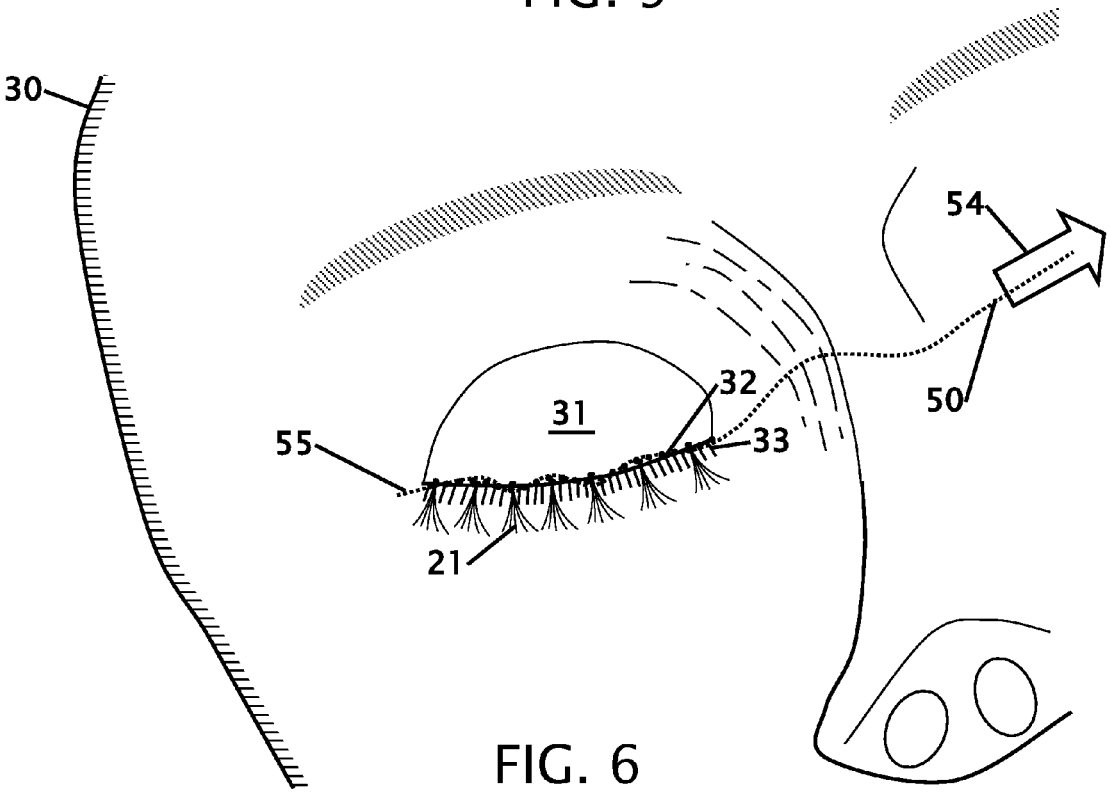
FIG. 6 shows the fourth step of distributing the glue through the lashes.

FIG. 6 shows the fourth step of distributing the glue through the lashes. The thread 50 is pulled 54 or drawn through the eyelashes to distribute the eyelash glue between the natural lashes 33 of the customer and the false flare lashes 21. The end 55 of the thread 50 is not pulled through the lashes and can remain a desired length outside of the natural lashes. This ensures that eyelash adhesive exists at and around the natural and false eyelashes to ensure a complete bonding of all surfaces.

Figure 7:
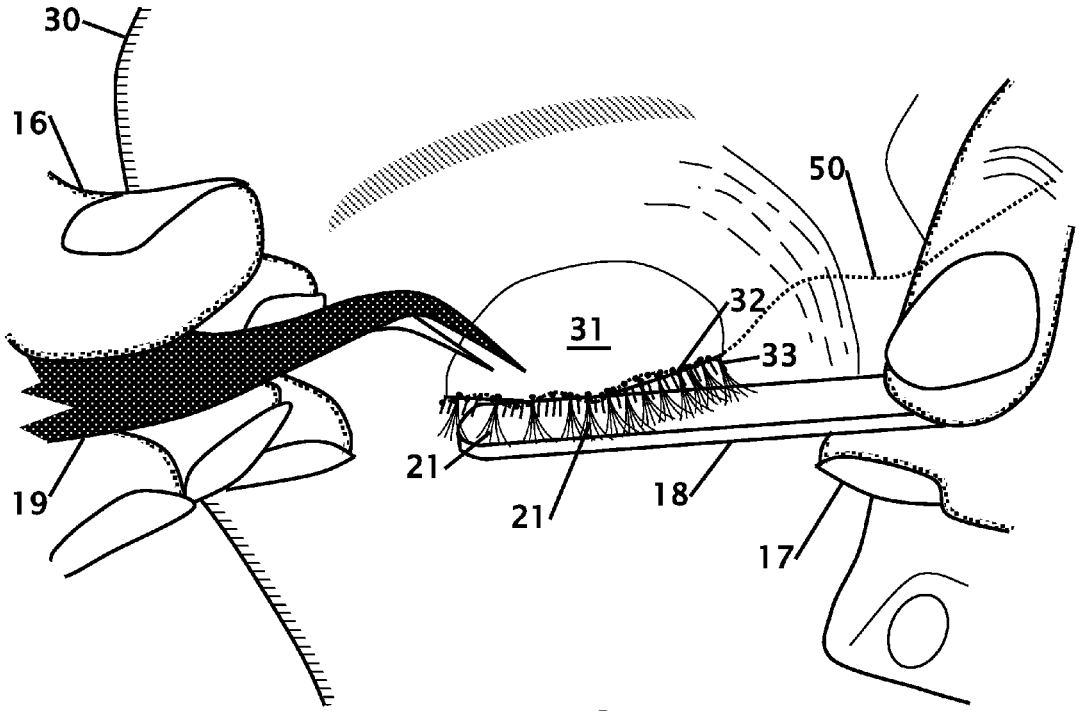
FIG. 7 shows the fifth step of filling-out the eyelashes.

FIG. 7 shows the fifth step of filling-out the eyelashes. The beautician 16 will then apply additional false flare lashes 21 in the spaces between the false flare lashes 21 to provide a more completely filled appearance. Some eyelash glue usually still exists on the thread 50 and provides a more complete bonding for the second layer of the flare lashes 21, the thread 50 and the natural lashes 33. This fills-out the lashes and hides the bonding thread 50.

Figure 8:
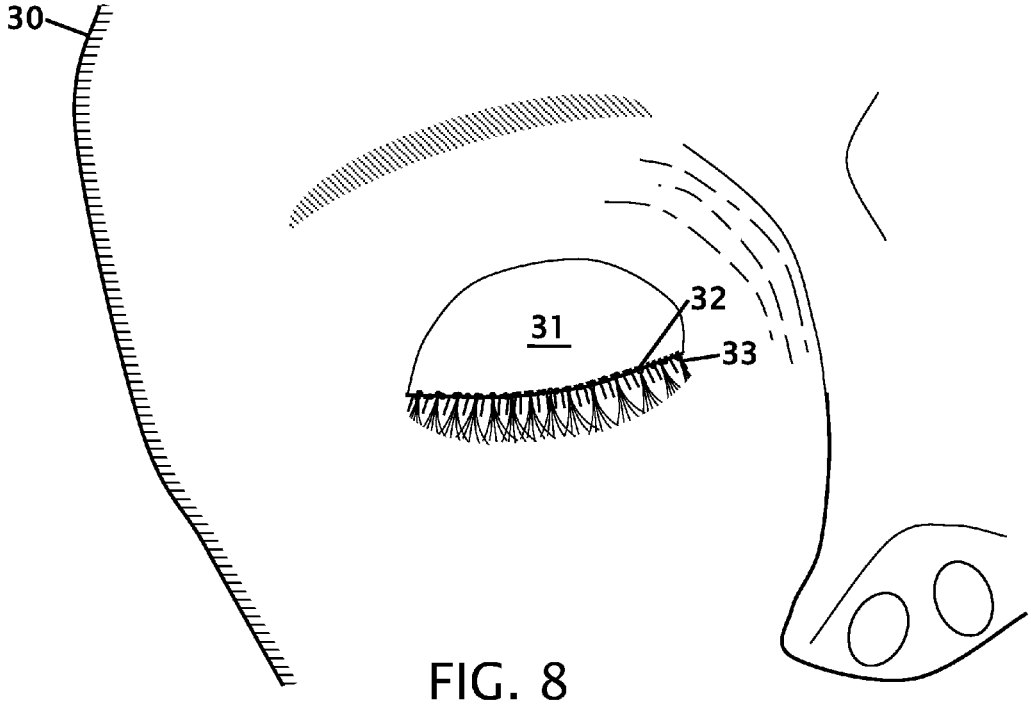
FIG. 8 shows the final processes to complete the application of the false eyelashes.

FIG. 8 shows the final processes to complete the application of the false eyelashes. The loose end of the thread is sewn into the lashes or the loose end(s) can be knotted. Mascara is applied over the lashes to cohesively bond the components as a single unit. A sealer is then applied over the assembly to seal the mascara, fake lashes, real lashes and the thread. The beautician can then shape the resulting eyelashes and add color as desired.

In general, eyelashes completely grow in eight to 12 weeks. Because all of the elements are bonded in a cohesive group a failure of individual elements will not allow the individual elements to dislodge and fall away. In the example shown, only one superior eyelid is shown with the false eyelashes, but it should be obvious to one skilled in the art that the method of bonding false eyelashes can be equally applied to the opposing eye as well as on the inferior eyelid.

Thus, specific embodiments of a method of bonding false eyelashes have been disclosed. It should be apparent, however, to those skilled in the art that many more modifications besides those described are possible without departing from the inventive concepts herein. The inventive subject matter, therefore, is not to be restricted except in the spirit of the appended claims.

The invention claimed is:

1. A method of bonding false eyelashes comprising:

applying a first plurality of false eyelash segments to the eyelid in proximity to an eyelid and natural grown eyelashes;

weaving a thread in an alternating manner around said plurality of false eyelash segments and said natural grown lashes;

distributing eyelash glue between said plurality of false eyelash segments and said natural grown lashes;

applying a second plurality of false eyelash segments between said first plurality of false eyelash segments, and sealing said natural eyelashes to said thread said first and said second plurality of eyelash segments.

2. The method of bonding false eyelashes according to claim 1 wherein said waving is with a needle made from hair or plant material.

3. The method of bonding false eyelashes according to claim 2 wherein said needle has an eye whereby said thread is insertable.

4. The method of bonding false eyelashes according to claim 1 wherein said distributing of eyelash glue is by applying said eyelash glue along a first end segment of said thread and pulling on a second end of said thread.

5. The method of bonding false eyelashes according to claim 4 wherein said eyelash glue is striped from said thread by said natural grown lashes.

6. The method of bonding false eyelashes according to claim 5 wherein said eyelash glue bonds said natural grown lashes to said false lashes.

7. The method of bonding false eyelashes according to claim 4 wherein said eyelash glue is striped from said thread by said false eyelashes.

8. The method of bonding false eyelashes according to claim 7 wherein said eyelash glue bonds said false lashes to said natural grown lashes.

9. The method of bonding false eyelashes according to claim 4 wherein said first end is nearest to said needle.

10. The method of bonding false eyelashes according to claim 4 wherein said first end is a free end of said thread.

11. The method of bonding false eyelashes according to claim 1 that further includes applying a mascara bond prior to application of said sealing.

12. The method of bonding false eyelashes according to claim 1 wherein said plurality of false eyelashes are flare lashes.

13. The method of bonding false eyelashes according to claim 1 wherein said bonded false eyelashes and said natural grown lashes are bonded as a collective single joined element.

14. The method of bonding false eyelashes according to claim 1 wherein each of said plurality of false eyelashes are connected at a first end and flare to individual hairs at a second end.

15. The method of bonding false eyelashes according to claim 1 wherein said false lashes are have different flare lengths.

16. The method of bonding false eyelashes according to claim 1 wherein said false lashes are longer than said natural grown lashes.

17. The method of bonding false eyelashes according to claim 1 wherein said false lashes are equally distributed along said eyelid.

18. The method of bonding false eyelashes according to claim 1 wherein said thread is human hair.

19. The method of bonding false eyelashes according to claim 1 wherein said thread is from a person who is having said false lashes applied.

20. The method of bonding false eyelashes according to claim 1 wherein said false eyelashes are applied to both upper natural eyelashes and lower natural eyelashes.

* * * * *